US005454209A

United States Patent [19]

Kikuchi

[11] Patent Number: 5,454,209

[45] Date of Patent: Oct. 3, 1995

[54] PACKAGING METHOD

[75] Inventor: Shuichi Kikuchi, Miyagi, Japan

[73] Assignee: Sony Corporation, Tokyo, Japan

[21] Appl. No.: 909,752

[22] Filed: Jul. 7, 1992

[30] Foreign Application Priority Data

Jul. 12, 1991 [JP] Japan ..... 3-197371

[51] Int. Cl.[6] ..... B65B 61/02

[52] U.S. Cl. ..... 53/411; 53/415

[58] Field of Search ..... 53/411, 415, 135.1, 53/136.1; 206/459.1, 460

[56] References Cited

U.S. PATENT DOCUMENTS

| | | | |
|---|---|---|---|
| 3,698,551 | 10/1972 | Tomlinson | 53/415 |
| 4,359,358 | 1/1982 | Hattemer | 206/460 |
| 4,505,389 | 3/1985 | Whiteside | 206/460 |
| 4,709,397 | 11/1989 | Voshall | 206/459.1 |
| 4,972,953 | 11/1990 | Friedman | 206/459.1 |
| 5,022,526 | 6/1991 | Crum | 206/460 X |

FOREIGN PATENT DOCUMENTS

| | | | |
|---|---|---|---|
| 638614 | 3/1962 | Canada | 53/411 |
| 1129683 | 1/1957 | France | 53/136.1 |

*Primary Examiner*—Linda Johnson
*Attorney, Agent, or Firm*—Ronald P. Kananen

[57] ABSTRACT

A method of packaging an article, such as a disk cassette or a tape cassette, in a wrapping film having at least a printed portion to be attached adhesively to the surface of the article comprises wrapping the article in the wrapping film, and pressing the printed portion to the surface of the article to attach the printed portion adhesively to the surface of the article so that the printed portion remains on the surface of the article when the wrapping film is torn off. Characters and patterns to be formed on both the article and the wrapping film are printed on the wrapping film and the characters and patterns to be formed on the surface of the article are formed in the printed portion of the wrapping film and the printed portion is attached adhesively to the surface of the article when the article is wrapped in the wrapping film. Therefore, nothing needs to be printed on the article, which reduces the manufacturing cost of the article.

2 Claims, 3 Drawing Sheets

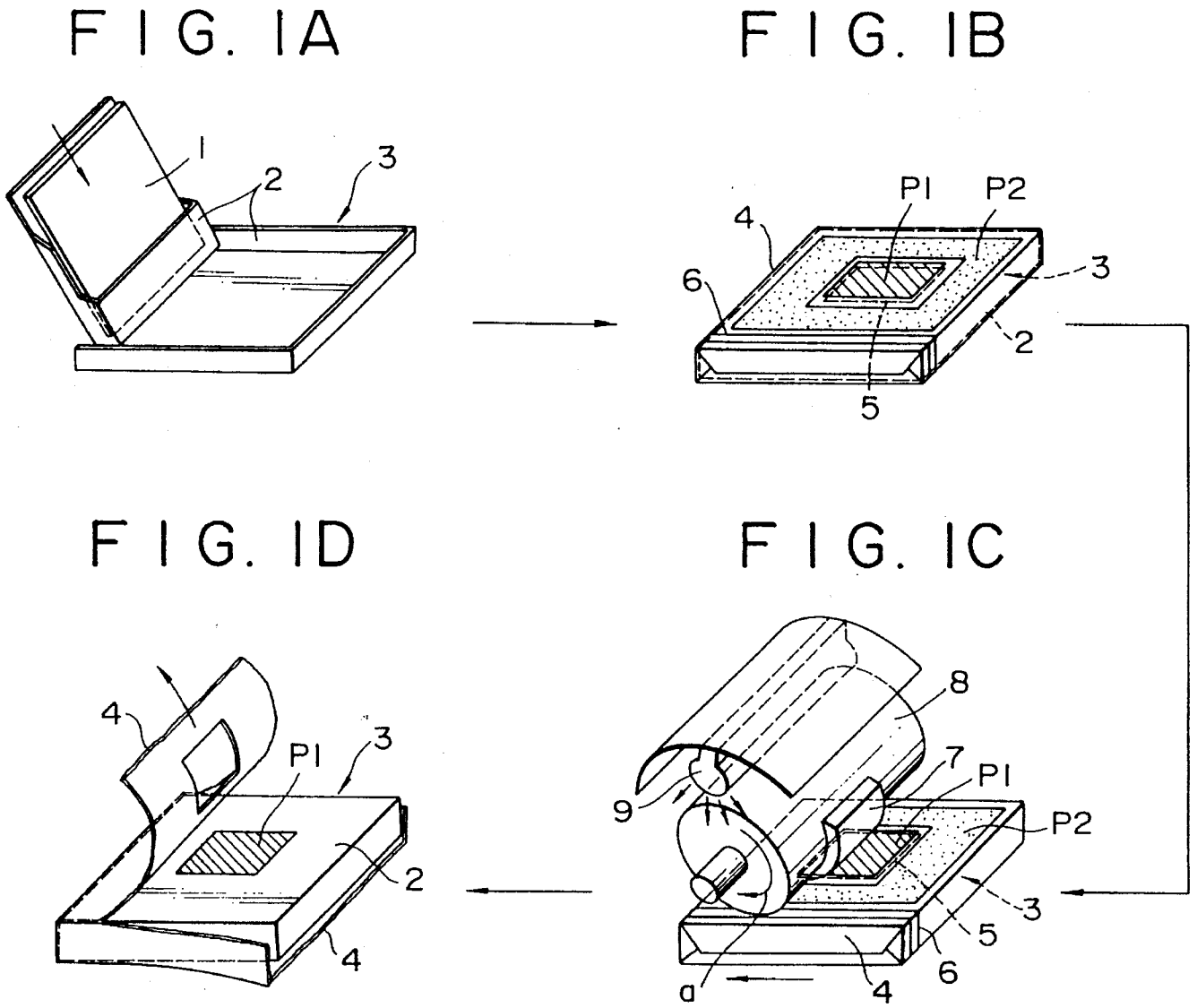
FIG. IA
FIG. IB
FIG. IC
FIG. ID
1
2
3
4
5
6
7
8
9
P1
P2
a

PACKAGING METHOD

BACKGROUND OF THE INVENTION

1. Field of the Invention

The present invention relates to a packaging method suitable for packaging articles, such as disk cassettes and tape cassettes.

2. Description of the Prior Art

Generally, articles, such as disk cassettes and tape cassettes, are sold in packets formed by packaging the articles in a transparent wrapping film what is known as an overwrapping film, and the wrapping film is torn off in using the articles. Although the wrapping film wrapping articles is used only once and thrown away after being torn off, color pictures, characters and/or color patterns are printed on the wrapping film to set off the appearance of the articles in displaying the articles for sale. Usually, images including the name of the manufacturer, the name of the article and instructions are printed on the articles, such as disk cassettes and tape cassettes.

Thus, it has been necessary to print images and patterns on both wrapped articles, such as disk cassettes and tape cassettes, and wrapping films wrapping the articles, which increases the cost of the articles. Disk cassettes and tape cassettes, in particular, require very troublesome printing work because they must be printed individually after the same have been manufactured.

SUMMARY OF THE INVENTION

The present invention has been made to solve the foregoing problems and it is therefore an object of the present invention to provide a packaging method using a printed wrapping film that makes printing on wrapped articles unnecessary.

In one aspect of the present invention, a packaging method for wrapping an article in a wrapping film glues a printed portion of the wrapping film to the article in wrapping the article in the wrapping film.

Thus, the printed portion of the wrapping film glued to the article and carrying necessary information remains on the article when the wrapping film is torn off. Accordingly, nothing needs to be printed on the article, which curtails the packaging cost greatly.

When the packaged article is displayed for sale, the printed portion of the wrapping film glued to the article forms a primary decorative pattern in combination with other portions of the wrapping film. When the wrapping film is torn off the article, the glued, printed portion remains on the article to form a secondary decorative design. Thus, the wrapping film can be utilized for both packaging and decorating the article.

BRIEF DESCRIPTION OF THE DRAWINGS

The above and other objects, features and advantages of the present invention will become more apparent from the following description taken in connection with the accompanying drawings, in which:

FIGS. 1A, 1B, 1C and 1D are perspective views of assistance in explaining a packaging method in a preferred embodiment according to the present invention;

DESCRIPTION OF THE PREFERRED EMBODIMENTS

Figure 2A:
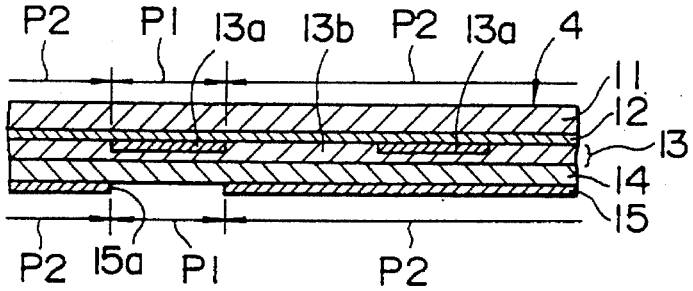
FIGS. 2A, 2B and 2C are sectional views of assistance in explaining a method of manufacturing a wrapping film and a manner of transferring a portion of the wrapping film to an article.

An article 3 to be packaged is a plastic case 2 containing a disk cassette 1, such as a 3.5 in. MFD, as shown in FIG. 1A. As shown in FIG. 1B, the article 3 is wrapped in a wrapping film 4, such as an overwrapping film. Generally, the wrapping film 4 is transparent and color pictures, characters and/or color patterns are printed in a decorative design in printed portions P1 and P2 by multicolor printing. The inner surface of the printed portion P1 of the wrapping film 4 is coated with a glue 5, such as a thermal adhesive. If necessary, the inner surfaces of two or more than two printed portions of the wrapping film 4 may be coated with the glue 5. The wrapping film 4 is lined with a cutting tape 6.

After wrapping the article 3 in the wrapping film 4 as shown in FIG. 1C, a pressure roller 8 formed of silicone rubber or the like, provided with a protrusion 7 on its circumference, and heated by an infrared lamp 9, i.e., a heating means, is rolled in the-direction of the arrow a to press the printed portion P1 of the wrapping film 4 against the surface of the case 2 of the article 3 with the protrusion 7 so that the printed portion P1 is attached adhesively to the surface of the case 2 of the article 3 by the glue 5 coating the inner surface of the printed portion P1.

The article 3 thus wrapped in the wrapping film 4 is sent to shops and displayed for sale.

In using the article 3, the wrapping film 4 is torn by means of the cutting tape 6 and the wrapping film 4 is removed from the article 3. In removing the wrapping film 4 from the article 3, the wrapping film 4 is torn along the perimeter of the printed portion P1 adhering to the case 2 and only the printed portion P1 remains on the surface of the case 2. Thus, the characters and/or patterns printed on the printed portion P1 are marked on the article 3, i.e., the case 2 containing the disk cassette 1 in a secondary decorative design. Since the characters and/or patterns printed on the printed portion P1 may be printed only on the wrapping film 4 simultaneously with those printed on the other printed portion P2, the characters and/or patterns of the printed portion P1 need not be printed on the case 2 of the article 3, which reduces the printing cost, hence the manufacturing cost, of the article 3.

A method of manufacturing a wrapping film, in a first embodiment according to the present invention will be described hereinafter with reference to FIGS. 2A to 2C.

As shown in FIG. 2A, the wrapping film 4 of a laminate construction comprises a base film 11, such as a polyethylene terephthalate film of a thickness in the range of 20 to 30 μm, a separating layer 12 formed over the inner surface, i.e., the lower surface as viewed in FIG. 2A, of the base film 11 by spreading an easily fusible material, such as a thermoplastic acrylic, chlorinated polyolefine or a mixture of those materials, over the inner surface of the base film 11, a printing layer 13 formed over the inner surface of the separating layer 12, a thermal adhesive layer 14 of the glue 5 formed over the inner surface of the printing layer 13 by coating the lower surface of the printing layer 13 with an acrylic or vinyl acetate by a direct gravure process or the like, and a masking layer 15 formed over the inner surface of thermal adhesive layer 14.

Color pictures, characters and/or color patterns are formed in the printing layer 13 by multicolor printing. If metallic characters and patterns are desired to be formed in relief, first the metallic characters and patterns 13*a* are printed, and then the background 13*b* is colored with metallic ink by evaporation or the like. If characters and patterns 13*a* are desired to be formed in relief, for example, in white on a black background, first the characters and patterns 13*a* are printed with white ink, and then the background 13*b* is printed with black ink.

The masking layer 15 masks the inner surface of the printed portion P2 entirely and has an opening 15*a* formed in a portion thereof corresponding to the printed portion P1 to be attached adhesively to the article 3. The masking layer 15 is formed by printing using an ink having a relatively high heat resistance.

Figure 3A:
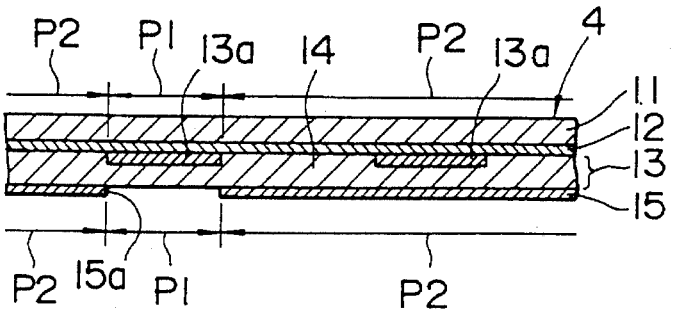
FIGS. 3A, 3B and 3C are sectional views of assistance in explaining another method of manufacturing a wrapping film and a manner of transferring a portion of the wrapping film to an article.

A method of manufacturing the wrapping film, in a second embodiment according to the present invention will be described hereinafter with reference to FIGS. 3A to 3C.

A wrapping film 4 to be manufactured by the method in the second embodiment is similar to that manufactured by the method in the first embodiment. The method in the second embodiment is similar to that in the first embodiment, except that the method in the second embodiment forms the thermal adhesive layer 14 of a colored thermal adhesive of a color corresponding to that of the background 13*b* to use a portion of the thermal adhesive layer 14 corresponding to the background 13*b* as the background 13*b*.

A manner of adhesively attaching the printed portion P1 to the case 2 of the article 3 and a manner of tearing the wrapping film 4 off the article 3 will be described hereinafter.

Figure 2B:
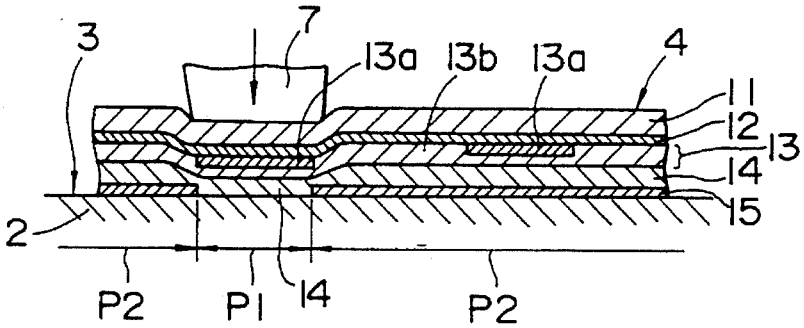
Figure 3B:
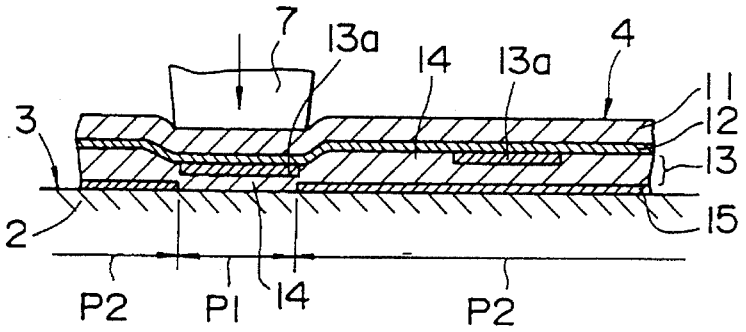

As shown in FIGS. 2B and 3B, the printed portion P1 is pressed elastically to the surface of the case 2 of the article 3 with the heated protrusion 7 of the pressure roller 8 (FIG. 1) and, consequently, a portion of the thermal adhesive layer 14 corresponding to the opening 15*a* of the masking layer 15 is pressed against the surface of the case 2 and the printed portion P1 is attached adhesively to the surface of the case 2.

Figure 2C:
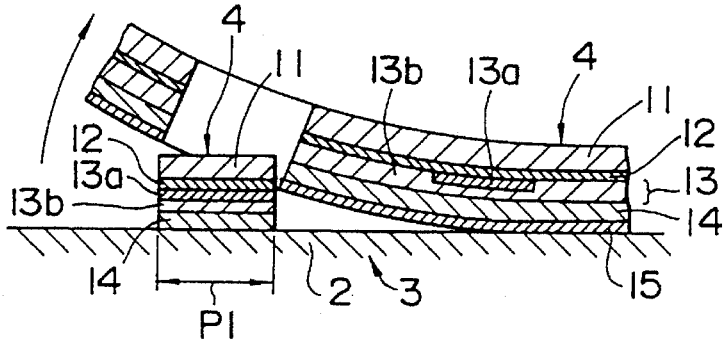
Figure 3C:
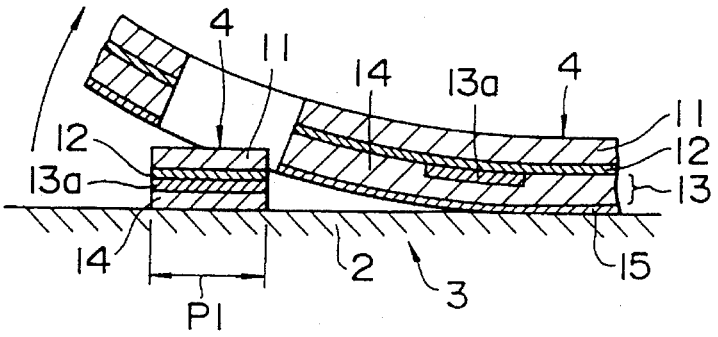

As shown in FIGS. 2C and 3C, when the wrapping film 4 is torn off, the wrapping film 4 is torn along the perimeter of the printed portion P1 and the printed portion P1 having the characters and patterns 13*a* remains on the surface of the case 2.

The adhesive layer 14 may be formed only over a portion of the printed layer 13 corresponding to the printed portion P1 and the masking layer 15 may be omitted.

The present invention is not limited in its application to packaging disk cassettes and tape cassettes; it is also possible to apply the present invention to packaging various articles in a wrapping film.

Although the invention has been described in its preferred form with a certain degree of particularity, obviously many changes and variations are possible therein. It is therefore to be understood that the present invention may be practiced otherwise than as specifically described herein without departing from the spirit and scope thereof.

What is claimed is:

1. A method of packaging an article in a wrapping film comprising the steps of:

providing a wrapping film having a separable portion to be attached adhesively to the surface of the article and a remaining portion;

printing characters and/or patterns desired to be formed on the surface of the article in a decorative design on an inner surface of the separable portion;

coating a portion of the inner surface of the wrapping film corresponding to the printed portion with an adhesive layer;

wrapping the article in the wrapping film;

pressing the printed portion of the wrapping film to the surface of the article; and attaching the printed portion adhesively to the surface of the article during said pressing step with an adhesive bond strong enough to separate the printed portion of the wrapping film from the remaining portion;

whereby the characters and/or patterns which are printed on the inner surface of the separable portion, remain on the surface of the article when the remaining portion of the wrapping film is torn off.

2. A method of packaging an article in a wrapping film comprising the steps of:

providing a wrapping film having a separable portion to be attached adhesively to the surface of the article and a remaining portion;

printing characters and/or patterns desired to be formed on the surface of the article in a decorative design on an inner surface of the separable portion of the wrapping film;

coating the inner surface of the wrapping film with an adhesive layer;

coating the surface of the adhesive layer with a masking layer having an opening in a portion corresponding to the printed portion wrapping the article in the wrapping film;

pressing the printed portion of the wrapping film to the surface of the article; and attaching the printed portion adhesively to the surface of the article during said pressing step with an adhesive bond strong enough to separate the printed portion of the wrapping film from the remaining portion;

whereby the characters and/or patterns remain on the surface of the article when the remaining portion of the wrapping film is torn off.

* * * * *